US009498758B2

(12) United States Patent
Larose

(10) Patent No.: US 9,498,758 B2
(45) Date of Patent: Nov. 22, 2016

(54) DILUTION APPARATUS

(71) Applicant: Robert Larose, East Hartford, CT (US)

(72) Inventor: Robert Larose, East Hartford, CT (US)

(73) Assignee: BioSafe Systems LLC, East Hartford, CT (US)

( * ) Notice: Subject to any disclaimer, the term of this patent is extended or adjusted under 35 U.S.C. 154(b) by 383 days.

(21) Appl. No.: 13/950,755

(22) Filed: Jul. 25, 2013

(65) Prior Publication Data

US 2014/0026984 A1 Jan. 30, 2014

Related U.S. Application Data

(60) Provisional application No. 61/677,281, filed on Jul. 30, 2012.

(51) Int. Cl.

| | |
|---|---|
| ***B01F 5/04*** | (2006.01) |
| ***B01F 3/08*** | (2006.01) |
| ***B01F 15/00*** | (2006.01) |
| ***B01F 15/04*** | (2006.01) |

(52) U.S. Cl.

CPC ..... *B01F 5/0403* (2013.01); *B01F 3/0861* (2013.01); *B01F 5/0413* (2013.01); *B01F 15/0035* (2013.01); *B01F 15/0412* (2013.01); *B01F 5/04* (2013.01); *B01F 5/0405* (2013.01); *B01F 2003/0896* (2013.01); *Y10T 137/7358* (2015.04)

(58) Field of Classification Search

CPC ..... B01F 5/04; B01F 5/0405; Y10T 137/7358

USPC ..... 137/409, 131

See application file for complete search history.

(56) References Cited

U.S. PATENT DOCUMENTS

| | | | | | |
|---|---|---|---|---|---|
| 2,508,170 | A | * | 5/1950 | Kaufmann | G01N 11/08 137/152 |
| 2,855,860 | A | * | 10/1958 | Crump | F04F 1/06 137/124 |
| 2,908,227 | A | | 10/1959 | McDougall | |
| 3,557,388 | A | * | 1/1971 | Bach | B63B 29/16 4/320 |
| 4,058,296 | A | * | 11/1977 | Wetherby | 137/890 |
| 4,109,831 | A | * | 8/1978 | Culpepper | F01M 11/0458 222/254 |
| 4,527,353 | A | * | 7/1985 | Newby | 47/59 R |
| 4,697,610 | A | | 10/1987 | Bricker et al. | |
| 4,714,196 | A | * | 12/1987 | McEachern et al. | 239/62 |
| 4,790,454 | A | * | 12/1988 | Clark et al. | 222/136 |
| 4,885,084 | A | * | 12/1989 | Doyle | 210/132 |

(Continued)

*Primary Examiner* — Michael R Reid
*Assistant Examiner* — Christopher Ballman
(74) *Attorney, Agent, or Firm* — Paul & Paul

(57) ABSTRACT

A dilution apparatus includes a container having an adjustable float-operated make-up valve wherein the make-up valve has an inlet end connected to a water supply tube and an outlet end connected to a fill tube inside the container. The make-up valve is connected to a float disposed inside the container. The water supply tube is connected to a reservoir that contains a concentrate. The water flow through the water supply tube siphons the concentrate, into the water stream and through the make-up valve to form a first dilution. A proportioner is connected to a water supply and to the bottom of the container. The water flow through the proportioner siphons the first dilution into the proportioner, thereby mixing the first dilution with water to form a final product having a predetermined dilution ratio.

4 Claims, 1 Drawing Sheet

(56) References Cited

U.S. PATENT DOCUMENTS

| | | | | |
|---|---|---|---|---|
| 5,213,694 | A | 5/1993 | Craig | |
| 5,544,810 | A * | 8/1996 | Horvath et al. | 239/10 |
| 6,092,364 | A * | 7/2000 | Stellwagen | 60/39.463 |
| 6,103,108 | A * | 8/2000 | Kohlenberg | 210/120 |
| 6,244,219 | B1 * | 6/2001 | Krum | A01K 63/04 119/231 |
| 6,749,131 | B2 * | 6/2004 | Knight | A01M 7/0089 239/124 |
| 7,661,604 | B1 * | 2/2010 | MacLean-Blevins | 239/10 |
| 2008/0233001 | A1 * | 9/2008 | Ricciardi et al. | 422/20 |
| 2009/0078791 | A1 * | 3/2009 | Guillon et al. | 239/398 |
| 2010/0200517 | A1 * | 8/2010 | Harris | C02F 1/001 210/760 |
| 2011/0278372 | A1 * | 11/2011 | Orubor | B01F 1/0033 239/141 |
| 2012/0195805 | A1 * | 8/2012 | Bialik | 422/264 |

* cited by examiner

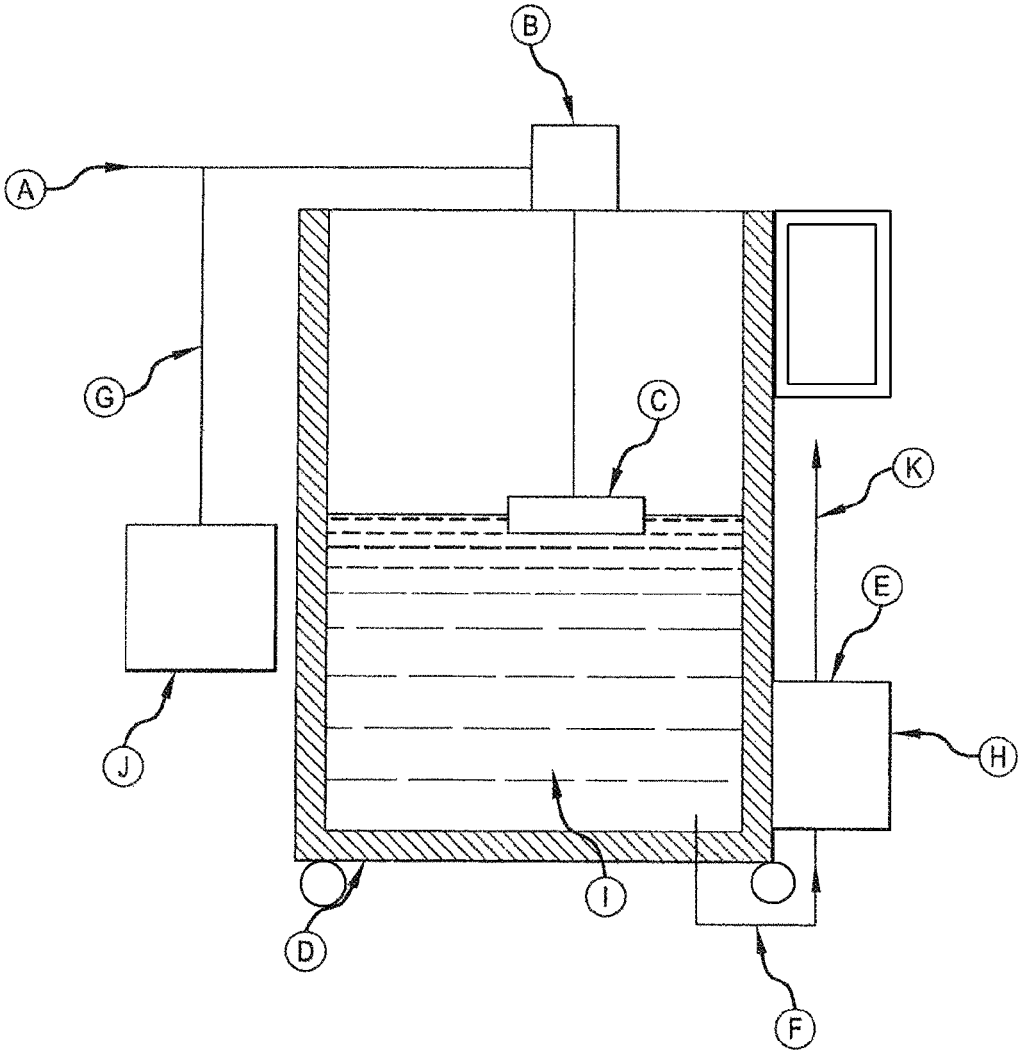
B
A
G
C
K
E
J
H
I
D
F

DILUTION APPARATUS

CROSS-REFERENCE TO RELATED APPLICATIONS

This application claims the benefit of U.S. Provisional Application Ser. No. 61/677,281, filed on Jul. 30, 2012, the entire contents of which are incorporated herein by reference.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

Application of dilute aqueous based fertilizers, herbicides, growth regulators and the like to plants many times requires on-site dilution of aqueous-based concentrates. In many instances, such dilution processes require the use of electrically powered metering pumps. However, access to electricity is not always available at remote application sites. In addition, sparking by electrically powered metering pumps in dilution operations involving concentrates that contain some flammable organic solvents could result in explosion and/or fire hazards.

BRIEF SUMMARY OF THE INVENTION

A dilution apparatus according to the invention is comprised of the following elements: (a) a container having an adjustable float-operated make-up valve on the top of the container, wherein the make-up valve has an inlet end connected to a water supply tube and an outlet end connected to a fill tube disposed inside the container, and wherein the make-up valve is connected to a float disposed in a liquid inside the container, and wherein the water supply tube is operatively connected by tubing to a reservoir containing a concentrate whereby the water flow through the water supply tube siphons the concentrate through the tube and into the water stream and through the make-up valve to form a first dilution inside the container; (b) a proportioner having a first inlet opening connected to a water supply, and a second inlet opening connected to a tube on one end and the other end is connected to the bottom of the container, whereby the water flow through the proportioner siphons the first dilution from the container through the tube and into the proportioner, wherein the first dilution is mixed with the water from the water supply to form a final product having a predetermined dilution ratio.

BRIEF DESCRIPTION OF THE DRAWING

FIG. 1 is a diagram of the apparatus according to the invention.

DETAILED DESCRIPTION OF THE INVENTION

The present invention pertains to an apparatus for mixing liquids. More specifically, the present invention pertains to an apparatus for diluting liquid concentrates with water in high dilution ratios without the need for expensive mixing equipment such as metering pumps and the like. The apparatus according to the invention is powered by water pressure supplied by a source as simple as a garden hose and can be used in areas where there is explosive danger due to electrical sparking, or in remote areas where electricity is not available.

An apparatus according to the invention can be made to be portable so that it can be conveniently transported to a work site wherein concentrates such as fertilizers, herbicides and the like can be diluted in high water-to-concentrate ratios for immediate application. For example, the apparatus can be made into the form of a tank having an integrated handle and fitted with all terrain wheels so that it can be easily moved over most surfaces. The apparatus according to the invention is powered by water pressure and, therefore, requires no electrical hook up.

The operation of the device according to the invention can be explained by reference to FIG. 1. Water from a typical water supply system that supplies from about 2 to about 12 gallons per minute at a pressure of about 120 psi or less is fed via inlet tube A into the adjustable float-operated make-up valve B. At the same time, another water supply stream, H, operating under the same parameters as described above is fed into proportioner E. The flow of water through tube A creates a suction which pulls concentrate J through siphon tube G into tube A and into the adjustable float-operated make-up valve B wherein the two liquids are mixed to form the first dilution I and fed into container D. The liquid level inside the container D is maintained at a pre-set value by the position of the float C. When the liquid level drops below that level, the float lowers and thereby opens the valve in the adjustable float-operated make-up valve B to permit additional liquid to enter the container D. Siphon tube G contains a nozzle insert that has been pre-engineered to permit only a certain amount of liquid to flow through it. The water flow through tube H into the proportioner E siphons the first dilution from the container D through tube F and into the proportioner E wherein the first dilution is further diluted with the incoming water to form the final diluted product K.

The adjustable float operated make-up valve is comprised of a float which floats in the liquid contained in the first container, a make-up valve which can be, inter alia, of the pilot-operated diaphragm-type and a chain or some other flexible connector which connects the float to the make-up valve. An example of an adjustable float operated make-up valve is described in U.S. Pat. No. 5,213,694, the entire contents of which are incorporated herein by reference. An adjustable float-operated make-up valve can be obtained, for example, from Hydro Systems Company, Cincinnati, Ohio, under the trademark name Hydrominder.

The container can be any hollow vessel that can function as a container and can be in the shape of a cylinder, a square or rectangular box, and the like. The material of construction of the container can be anything that will not react with the liquid contents, examples of which include, but are not limited to, plastics such as polyethylene, polyethylene-propylene; fluorinated ethylene-propylene; Teflon; metals such as aluminum and stainless steel. The tubing described herein can be flexible such as PVC, Teflon and the like, or non-flexible such as aluminum, copper, stainless steel and the like.

The proportioner can be any fluid mixing device that mixes two or more liquids, an example of which is a well known faucet proportioner. In a typical device, the water from the faucet is directed through a venturi having a port connected to a source of a second liquid. The velocity of the water creates a pressure drop at the port, sucking the second liquid into the water at the venturi. The liquids are discharged in a combined stream. Such a proportioner device is described in, for example, in U.S. Pat. Nos. 2,908,227 and 4,697,610, the contents of which are incorporated herein by reference.

What is claimed is:

1. A dilution apparatus comprising: (a) a container having an adjustable float-operated make-up valve on the top of the container, wherein the make-up valve has an inlet end connected to a water supply tube and an outlet end connected to a fill tube disposed inside the container, and wherein the make-up valve is connected to a float disposed in a liquid inside the container, and wherein the water supply tube is operatively connected by tubing to a reservoir containing a concentrate whereby the water flow through the water supply tube siphons the concentrate through the tube and into the water stream and through the make-up valve to form a first dilution inside the container; (b) a proportioner having a first inlet opening connected to a water supply, and a second inlet opening connected to a tube on one end and the other end is connected to the bottom of the container, whereby the water flow through the proportioner siphons the first dilution from the container through the tube and into the proportioner, wherein the first dilution is mixed with the water from the water supply to form a final product having a predetermined dilution ratio.

2. The apparatus of claim 1 wherein the container is plastic.

3. The apparatus of claim 2 wherein the plastic is polyethylene, polyethylene-propylene, fluorinated ethylene-propylene or Teflon.

4. The apparatus of claim 1 wherein the apparatus is in the form of a tank having an integrated handle and fitted with all terrain wheels.

* * * * *